US007994457B2

(12) United States Patent
Yoshidome

(10) Patent No.: US 7,994,457 B2
(45) Date of Patent: Aug. 9, 2011

(54) DRAWER-TYPE COOKING DEVICE

(75) Inventor: Akihiro Yoshidome, Yao (JP)

(73) Assignee: Sharp Kabushiki Kaisha, Osaka (JP)

( * ) Notice: Subject to any disclaimer, the term of this patent is extended or adjusted under 35 U.S.C. 154(b) by 536 days.

(21) Appl. No.: 12/138,322

(22) Filed: Jun. 12, 2008

(65) Prior Publication Data

US 2008/0307977 A1 Dec. 18, 2008

(30) Foreign Application Priority Data

Jun. 14, 2007 (JP) ..... 2007-157177

(51) Int. Cl.
*H05B 6/64* (2006.01)

(52) U.S. Cl. ..... 219/756; 219/763; 219/403; 126/340; 99/443 R

(58) Field of Classification Search ..... 99/443 R, 99/44, 447, 401, 385; 219/762, 756, 757, 219/758, 403; 126/190–194, 92, 146, 680, 126/681, 684, 339–340; 312/330.1, 249.11, 312/402, 34.18, 334.7, 334.14, 334.19, 334.21, 312/334.34, 334.35, 334.41, 334.42, 348.4
See application file for complete search history.

(56) References Cited

U.S. PATENT DOCUMENTS

| | | | | |
|---|---|---|---|---|
| 3,131,981 | A * | 5/1964 | Scott et al. | 312/222 |
| 6,849,835 | B2 | 2/2005 | Bollmers et al. | |
| 2005/0173399 | A1 * | 8/2005 | Yoshidome et al. | 219/403 |

FOREIGN PATENT DOCUMENTS

| | | | |
|---|---|---|---|
| JP | 3-45820 | A | 2/1991 |
| JP | 6-109257 | A | 4/1994 |
| JP | 11-237053 | A | 8/1999 |
| JP | 2002-181340 | A | 6/2002 |
| JP | 2005-221081 | A | 8/2005 |
| JP | 2006-38296 | A | 2/2006 |
| JP | 2006-038300 | A | 2/2006 |

* cited by examiner

*Primary Examiner* — Quang T Van
*Assistant Examiner* — Jianying Atkisson
(74) *Attorney, Agent, or Firm* — Birch, Stewart, Kolasch & Birch, LLP

(57) ABSTRACT

A cooking device with a heating chamber therein. A drawer with a body portion having a heating container and a door that closes the heating chamber when the heating container is inserted into the heating chamber. A moving mechanism operable to engage the door in a manner to support the drawer while moving it from a closed position in which the door closes the heating chamber with the heating container inserted into the heating chamber to an open position with the heating container outside of the open heating chamber to permit objects to be placed in and removed from the exposed heating container. In order to facilitate easy access to the heating container when the drawer is in the open position, the moving mechanism is positioned below the heating container.

3 Claims, 7 Drawing Sheets

DRAWER-TYPE COOKING DEVICE

The present application is based on and claims priority of Japanese patent application No 2007-157177 filed on Jun. 14, 2007, the entire contents of which are hereby incorporated by reference.

BACKGROUND OF THE INVENTION

1. Field of the Invention

The present invention relates to a drawer-type cooking device comprising a cooking device body having a heating chamber, and a drawer body movably disposed by a slide rail in the cooking device body such that the drawer body can be drawn out from the heating chamber of the cooking device body to the outside.

2. Description of the Related Art

There has been conventionally proposed a cooking device comprising an apparatus body having a cooking chamber in which an object to be cooked is housed, a door for shielding the cooking chamber from outside, a bottom plate moving in conjunction with the door, a sliding mechanism for sliding the bottom plate out of/in the cooking chamber, a motor for driving the bottom plate, transmission means for transmitting a drive force of the motor to the bottom plate, a latch device for opening and retaining the door, a door open/close switch, and a control circuit for controlling drive of the motor so as to operate the door upon reception of a signal from the door open/close switch (Japanese Patent Laid-Open Publication No. H3-045820 (Patent Document 1)). The bottom plate is directly coupled to the lower portion of the door in the vicinity of the lower hem. When the door is opened, the sides of the bottom plate are in an open state.

Also, there has been proposed a cooking device in which a slide body in which an object to be heated is housed is slidably provided in a cooking device body, comprising detecting means for detecting that the slide body has been slide out, control means for outputting an excitation command signal when receiving a detection signal from the detecting means, and an electromagnet leg portion disposed on the bottom face of the cooking device body and excited when receiving the excitation command signal (Japanese Patent Laid-Open Publication No. H6-109257 (Patent Document 2)). When the slide body is slide out, the excitation command signal is output from the control means based on detection by the detecting means, and the electromagnet leg portion disposed on the bottom face of the cooking device body is excited. The electromagnet leg portion is chucked to a metallic placing face to prevent the cooking device from being turned over, so as to use the cooking device in a stable state all the time.

Also, there has been proposed a microwave oven, wherein a heating container having an opening in its top is provided so as to be freely drawn out from a body housing, a heating chamber for confining microwave is formed by the heating container and a lid portion provided in the body housing side and covering the opening of the heating container, and electromagnetic wave leakage is prevented by providing a choke groove between an opening peripheral portion of the heating container and the lid portion facing the opening peripheral portion, so as to eliminate the electromagnetic wave leakage even if a food placing portion has a movable drawer structure (Japanese Patent Laid-Open Publication No. H11-237053 (Patent Document 3)).

There has been proposed a cooking device in which a placing portion of an object to be heated of a heating chamber has a drawable structure, comprising a cooking device body having a heating chamber, a drawer body movably disposed in the cooking device body such that the drawer body can be drawn out from the heating chamber of the cooking device body to the outside, and a slide rail for moving the drawer body in the cooking device body, wherein the slide rail is disposed outside of the heating chamber, so that it is not necessary to form the sliding mechanism with a part or a material having high heat resistance and flame resistance and it is possible to prevent the occurrence of faulty discharge by microwave (Japanese Patent Laid-Open Publication No. 2005-221081 (Patent Document 4)).

There has been proposed a slide-type cooking device, wherein a drawer body having a door and a heating container in which an object to be heated is placed therein is disposed in a cooking device body in which a heating chamber using microwave is formed therein, in a movable manner between a housed position where the heating container is housed in the heating chamber, and a drawn-out position where the heating container is drawn out from the heating chamber to the outside, and a sliding mechanism allowing the drawer body to be moved is constituted by right and left slide rails outside of the heating chamber and a center slide rail in which a drive mechanism is disposed, the respective slide rails and the drive mechanism being disposed isolatedly from the heating chamber, so that the slide rails and the drive mechanism are not exposed to a high temperature and a microwave or are not affected by food debris which could cause a breakdown (Japanese Patent Laid-Open Publication No. 2006-38296 (Patent Document 5)). Also, there has been disclosed a drawer-type food warmer having a moving rail only on the bottom face and in which the right and left side faces are opened (U.S. Pat. No. 6,849,835B2 (Patent Document 6)).

The inventions described in the above respective documents seem to have following points to be improved concerning supporting of the door. That is, in the inventions disclosed in the Patent Documents 1 to 3, the lower side portion of the door is only butt against the bottom plate to be fixed thereto. Thus, in the case where the door is heavily loaded by body weight, a heated object or the like, an attachment portion of the door and the bottom plate could be deformed. If the attachment portion is deformed, there is a possibility that microwave for heating leak from a gap generated between the inclined door and the body to the outside, and it is necessary to handle the apparatus with enough caution.

In the Patent Document 4, the moving mechanism is provided in right and left side walls outside of the heating chamber, and an angle for attaching the moving mechanism is fixed to the door. Therefore, a force acting on the door is supported by the cooking device body by being relatively dispersed via the moving mechanism provided in the right and left and the center of the lower portion. Even when the drawer body is drawn out, the door is not inclined forward and is stably supported by the cooking device body. However, in the Patent Document 4, the moving mechanism disposed in the right and left side wall faces extend through the right and left sides of the heating container when the drawer body is drawn out. Thus, when an object to be heated, for example, a heavy object such as a pot with soup therein or the like is put into or removed from the heating container which is combined with the door, the moving mechanism stands in the way, and the usability is low. Furthermore, from the standpoint of appearance, the visual quality needs to be improved. Also, the Patent Document 5, in which the moving mechanism for supporting the door of the drawer body is disposed at three places of right and left side wall faces and a bottom wall face outside of the heating chamber, has the similar points to be improved as those of the Patent Document 4. Furthermore, although the Patent Document 6 has such a similar point that the Patent Document 6 has a drawer structure, the Patent Document 6 discloses not the cooking device, but an electric warming device, in which the drawer is only manually operated and does not have an electric moving mechanism. The electric warming device does not have an electromagnetic wave sealing mechanism or a latch hook as a safety mechanism since it is not a microwave oven. Since the drawer does not have the electric mechanism, a moving mechanism simply by a lower rail is employed.

FIG. 5 is a perspective view of a drawer-type cooking device having a conventional structure. FIG. 6 is a side view of the drawer-type cooking device shown in FIG. 5. FIG. 7 is a perspective view illustrating a main portion (an attachment portion of a door and a movable rail) of the drawer-type cooking device shown in FIG. 5 A cooking device body 1 has a heating chamber 3 for heat-cooking an object to be heated. A drawer body 2 is movably, namely, slidably disposed in the cooking device body 1 such that the drawer body 2 can be drawn out from the heating chamber 3 of the cooking device body 1 to the front side. The cooking device comprises a movable rail 8 formed of an angle member as a moving mechanism 4 for slidingly moving the drawer body 2 in the cooking device body 1. The drawer body 2 comprises a door 6 for opening and closing the heating chamber 3 and a heating container 7 for placing and housing an object to be heated. The heating container 7 has side walls in the right and left sides, a back wall in the back side disposed in the heating chamber 3 of the cooking device body 1, and an opening in the top, and the door 6 is attached to the front thereof When the door 6 closes an opening of the heating chamber 3, the internal space of the heating chamber 3 becomes a sealed space by internal wall faces of the cooking device body 1 and the drawer body 2, so as to prevent microwave from leaking.

The door 6 of the drawer body 2 is supported by the cooking device body 1 by right and left side wall faces located outside of the heating chamber 3 via the moving mechanism 4. The moving mechanism 4 comprises a fixed rail 9 and the movable rail 8 sliding along the fixed rail 9. The fixed rail 9 is attached to the right and left wall faces of the heating chamber 3 outside of the heating chamber 3 of the cooking device body 1. As shown in FIG. 6 and FIG. 7, the movable rail 8 is attached to an internal side wall face of the door 6 via a folded portion 10 so as to extend from the inside of the door 6 of the drawer body 2 to the inside of the heating chamber 3 of the cooking device body 1. Since the moving mechanism 4 for moving the drawer body 2 in the cooking device body 1 is disposed outside of the heating chamber 3, it is not necessary to use an expensive part or material having high heat resistance and flame resistance for the movable rail 8 and the fixed rail 9. Also, since the moving mechanism 4 is disposed outside of the heating chamber 3, a risk of discharge by microwave is eliminated without being affected by microwave emitted in the heating chamber 3.

Although such a configuration can be considered that the moving mechanism in the related art is concentrated only in the lower portion moving mechanism, in such a case, there is a possibility that power transmission to a latch hook at the time of opening and closing operations decreases, and there occurs a new problem that the reliability of the opening and closing operations of the latch hook and the durability of the latch hook portion are reduced or the like.

In the field of microwave oven, new distinct configuration of automatic drawer type is emerging of late, for which this invention is intended for a further improvement.

In traditional microwave ovens, customers can place a plate of food in the oven almost effortlessly with the door open. In case of drawer type microwave oven, even when the door is opened automatically, the door in front and drawer moving mechanisms on sides are reportedly making some customers uncomfortable.

This invention is intended to bring drawer type microwave oven a significant clearance in this respect of usability without compromising on door strength.

By focusing on the fact that the above problems of usability and appearance are caused by that the moving mechanism disposed in the right and left side wall faces are located in the right and left sides of the heating container when the drawer body is drawn out, there is such a problem to be solved that, in the drawer-type cooking device, a more sophisticated moving mechanism is to be obtained by devising coupling of the moving mechanism and the door which constitutes the drawer body.

An object of the present invention is to provide a drawer-type cooking device for facilitating to put and remove an object (an object to be heat-processed) into and from a heating chamber and improving the usability and visual quality by lowering, as much as possible, the height position of a slide rail which allows a drawer body to be slidable in the forward and backward directions with respect to a cooking device body.

SUMMARY OF THE INVENTION

A drawer-type cooking device according to the present invention comprises a cooking device body having a heating chamber formed therein; a drawer body having a heating container for housing an object to be heated and being drawable from the heating chamber, and a door capable of closing the heating chamber; and a moving mechanism for supporting the drawer body in the cooking device body outside of the heating chamber such that the drawer body can be opened and closed, wherein the moving mechanism is disposed in a lower position than the heating container in the cooking device body.

According to the drawer-type cooking device, since the moving mechanism is disposed in a lower position than the heating container, the moving mechanism does not appear in the right and left sides of the heating container in the state in which the drawer body is drawn out from the cooking device body via the moving mechanism. Therefore, the side spaces of the heating container are in an open state without being blocked by the moving mechanism. When an object to be heated as an object to be cooked is put into the heating container or an object to be heated in the heating container is removed therefrom, the object can be smoothly put or removed from the right and/or left sides of the heating container. Also, since the moving mechanism does not appear in the side spaces of the heating container in the state in which the drawer body is drawn out from the cooking device body, the visual quality when the drawer body is drawn out is improved.

According to the drawer-type cooking device configured as described above, the moving mechanism attached to the door is disposed not in the right and left sides of the heating container of the drawer body but is disposed below the heating container. Therefore, when the drawer body is drawn out, an object to be heated can be put into and removed from the heating container directly from the right and/or left sides. Particularly, it becomes easy for old people and children to use the cooking device. It gives the physically challenged, as well as the old, significant improvement in usability on automatic drawer type cooking devices. In the case where the moving mechanism is disposed in the sides of the heating container, a large lifting force is required to put and remove an object to be heated into and from the heating container over the moving mechanism or the door. However, such a large force is not required in the present invention.

Also, food debris or the like produced during heat-cooking is not attached to a rail constituting the moving mechanism or an attachment portion to the door, and thus, the usability is improved. Furthermore, since the moving mechanism does not appear in the sides of the heating container when the drawer body is drawn out, the cooking device appears to have a simple structure, and the visual quality can be thereby improved.

In the present invention, a front end portion for attaching the moving mechanism has an L shape as a whole which extends in the upper direction from a movable rail body formed of an angle member or the like inside the door. Accordingly, the moving mechanism can be disposed lower than the heating container without reducing the attachment strength to the door. That is, since the rigidity of the attachment portion of the door and the moving mechanism is improved by the L shape structure of the movable rail, the equivalent strength in comparison with a conventional door structure is ensured even when the attachment position is in the lower portion of the door. Accordingly, there is no problem on a latch hook operated at the time of opening and closing operations, which is disposed in the back end of the moving mechanism and has a narrow allowable width of the height position.

DETAILED DESCRIPTION OF THE PREFERRED EMBODIMENTS

Embodiments of a drawer-type cooking device according to the present invention will be described below based on the drawings.

Figure 1:
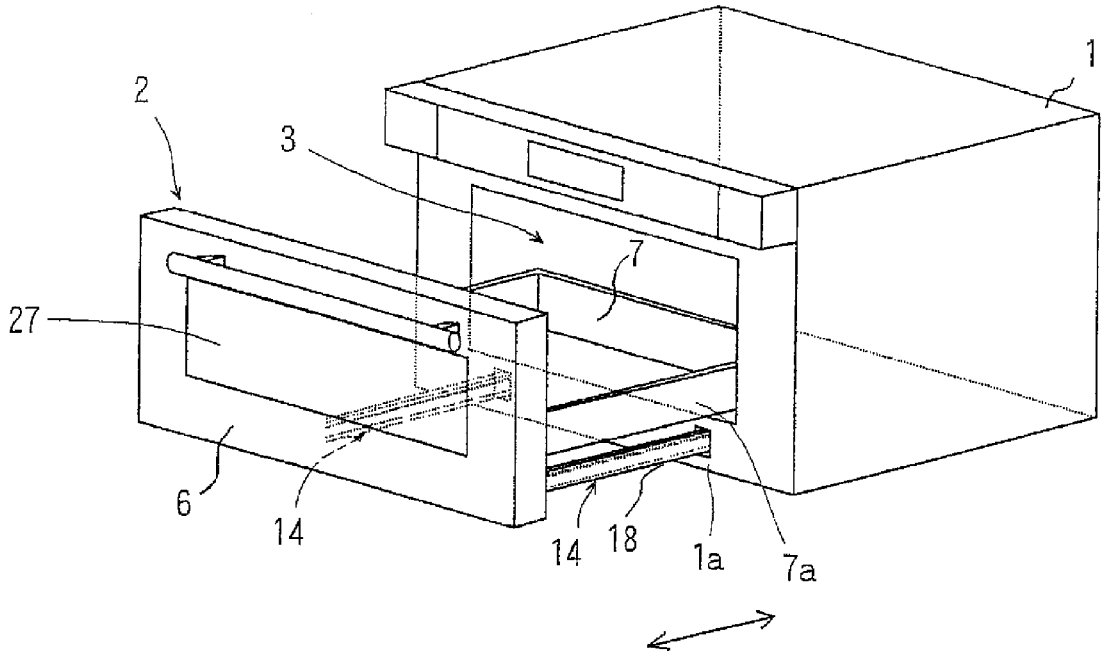
FIG. 1 is a perspective view illustrating one embodiment of a drawer-type cooking device according to the present invention.
Figure 2:
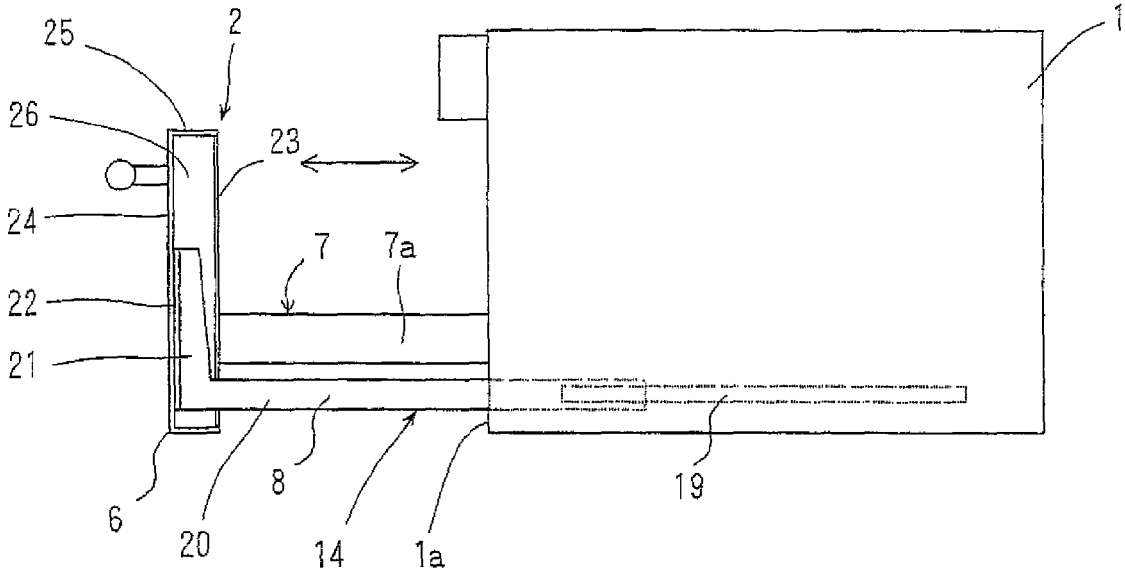
FIG. 2 is a side cross-sectional view of the drawer-type cooking device shown in FIG. 1.

FIG. 1 is a perspective view illustrating a configuration of a schematic appearance of a cooking device as an embodiment 1 of the present invention. FIG. 2 is a side view of the drawer-type cooking device shown in FIG. 1.

Figure 5:
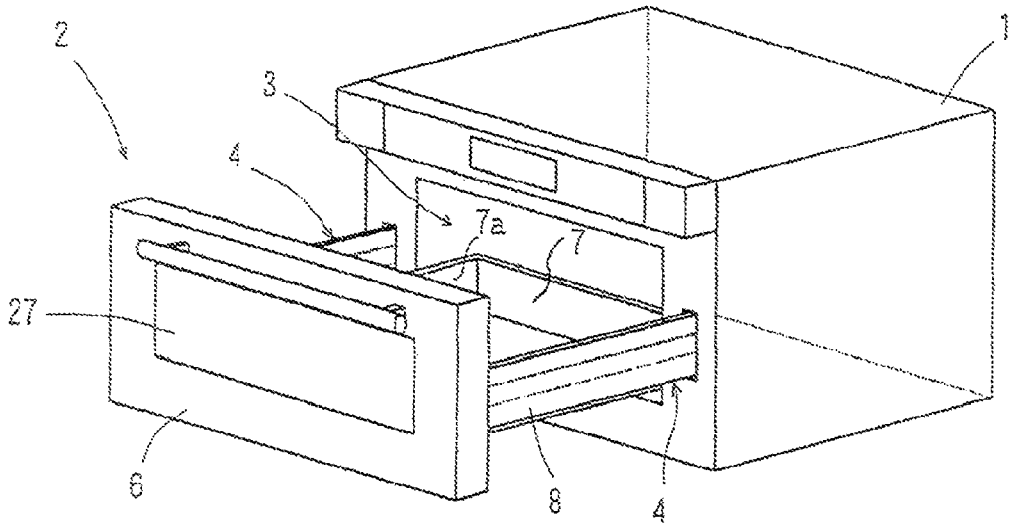
FIG. 5 PRIOR ART
FIG. 5 is a perspective view illustrating one example of a known drawer-type cooking device.
Figure 6:
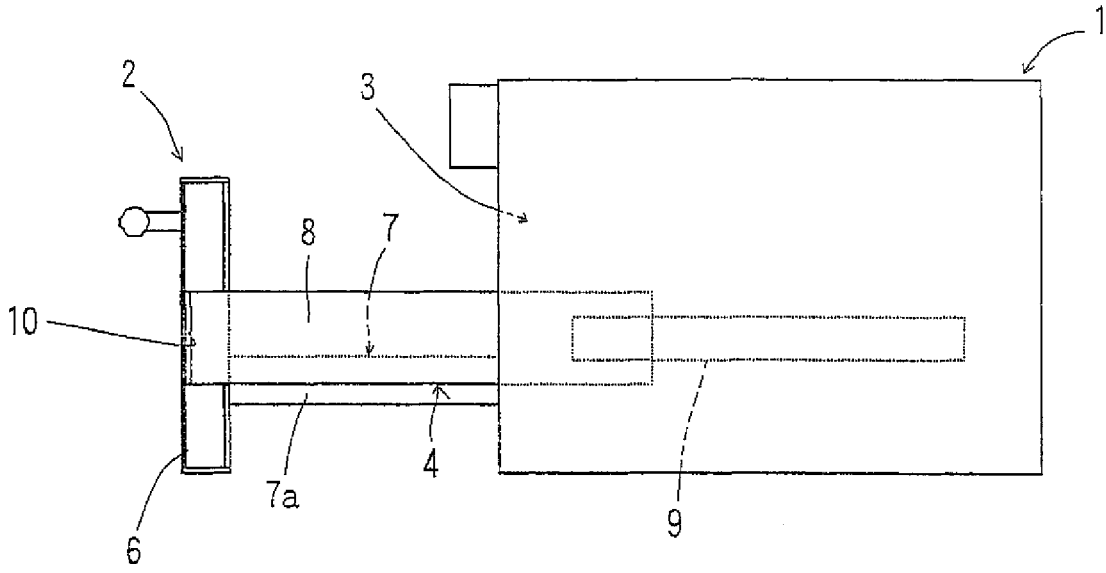
FIG. 6 is a side cross-sectional view of the drawer-type cooking device shown in FIG. 5.
Figure 7:
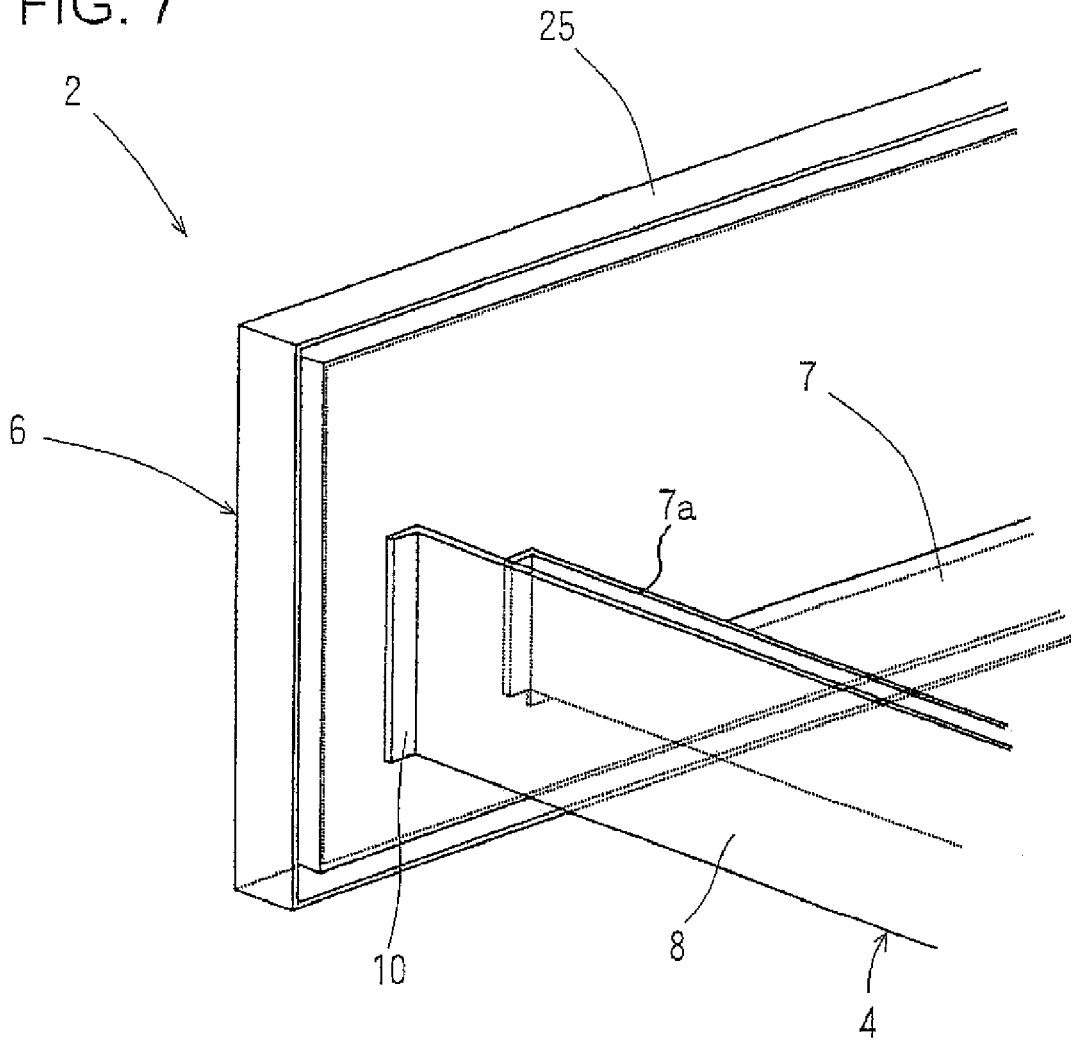
FIG. 7 is a perspective view illustrating a main portion of the drawer-type cooking device shown in FIG. 5.

In the embodiment of the drawer-type cooking device according to the present invention shown in FIG. 1 and FIG. 2, like reference numerals are used for like parts as those used in a known drawer-type cooking device shown in FIGS. 5 to 7 to omit the same description thereof.

In the embodiment shown in FIG. 1 and FIG. 2, the moving mechanism is disposed in a lower position than the heating container in the cooking device body.

According to the drawer-type cooking device, a drawer body 2 can be drawn out from a cooking device body 1 to the front side or can be pushed into the cooking device body 1 by a moving mechanism 14. The moving mechanism 14 comprises a movable rail 18 attached to a door 6 of the drawer body 2 and a fixed rail 19 fixed to the cooking device body 1, and is disposed in a lower position than a heating container 7, preferably below a heating chamber 3. The movable rail 18 slidably engages with the fixed rail 19 by a known structure.

As shown in FIG. 1, in the state in which the drawer body 2 is drawn out from the cooking device body 1 via the moving mechanism 14, the moving mechanism 14 does not appear in the right and/or left sides of the heating container 7, and the side spaces of the heating container 7 are in an open state without being blocked by the moving mechanism 14 Therefore, when an object to be heated as an object to be cooked is put into the heating container 7 or an object to be heated in the heating container 7 is removed therefrom, it is not necessary to put and remove the object over the door 6 and the object can be smoothly put and removed from the right and left sides of the heating container 7. Accordingly, even a heavy object to be heated such as an enamel pot with soup therein, for example, can be put into and removed from the heating container 7 with a relatively small energy without lifting the object high in the state in which the drawer body 2 is drawn out from the cooking device body 1. Also, since the moving mechanism 14 does not appear in the right and left side spaces of the heating container 7, the structure when the drawer body 2 is drawn out is simple and the visual quality is improved.

The movable rail 18 comprises a rail body 20 extending parallel to the fixed rail 19 and a front end portion 21 having an enlarged attachment end face 22 in the end of the door 6 side, and is attached to the door 6 via the enlarged front end portion 21. The moving mechanism 14 is disposed in a lower position than the heating container 7, and if the moving mechanism 14 is attached to the door in a position directly extending therefrom, the movable rail 18 is attached to the lower side portion of the door 6. With the attachment position, if the door 6 is heavily loaded (the case in which the door is loaded by the weight of a child, or a heavy object to be heated is placed on the door), the strength of the attachment portion is insufficient and the door 6 is easily in a forward inclined state. However, in the present embodiment, by providing the enlarged front end portion 21 to the movable rail 18, rigid attachment to the door 6 is ensured via the enlarged attachment end face 22, and the door 6 can be thereby prevented from being in the forward inclined state with respect to the moving mechanism 14. Accordingly, the moving mechanism 14 can be disposed below the heating container 7 without decreasing the strength of the door 6.

The door 6 has a box structure which is surrounded by an internal side wall 23, an external side wall 24 and a circumference wall 25 and has a space 26 formed between the internal side wall 23 and the external side wall 24. Also, a glass window 27 is provided to the door 6 such that the inside of the heating chamber 3 can be seen through the internal side wall 23 and the external side wall 24.

The rail body 20 of the movable rail 18 penetrates the internal side wall 23 of the door 6 and extends to the inside of the space 26 of the door 6. The enlarged front end portion 21 located inside the space is attached to an internal side face of the external side wall 24 of the door 6 in the attachment end face 22 by screwing or welding.

The movable rail 18 is formed of an angle member having a high strength against bending moment. The front end portion 21 of the movable rail 18 is bent and extends in the upper direction from the rail body 20, and is thereby formed in an L shape as a whole in its base. In this case, the front end portion 21 being bent and extending in the upper direction can be attached by utilizing an area extending in the height direction of the door 6, and the attachment area width and attachment strength of the door 6 and the movable rail 18 can be ensured. Also, the front end portion 21 of the movable rail 18 is housed in the space 26 having the box structure of the door 6. Therefore, the front end portion 21 of the movable rail 18 does not project outside of the internal side wall 23 of the door 6, and it is not necessary to form a concave portion or a groove as a back clearance of the front end portion 21 at the time of closing the door 6, in the front face of the cooking device body 1. The opening front face of the heating chamber 3 of the cooking device body 1 can be closed with a high sealing degree in plane contact with the outer face of the internal side wall 23 of the door 6.

Figure 3:
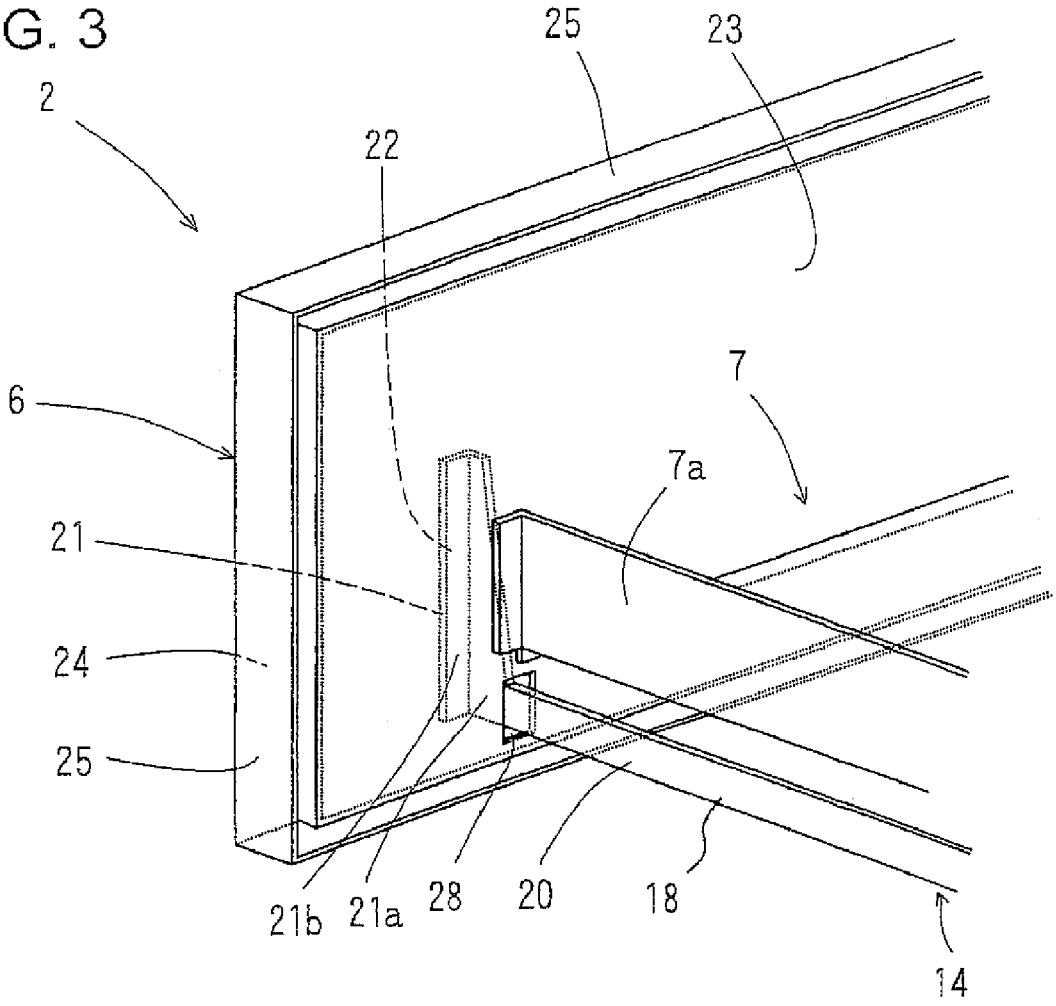
FIG. 3 is a perspective view illustrating a main portion of the drawer-type cooking device shown in FIG. 1.

FIG. 3 is a perspective view illustrating a main portion of the drawer-type cooking device shown in FIG. 1. The movable rail 18 of the moving mechanism 14 is located below a side portion frame 7a of the heating container 7. The movable rail 18 and the side portion frame 7*a* are disposed in approximately the same position in the width direction of the cooking device, and the structure simplicity can be thereby improved. Also, as shown in FIG. 1, the movable rail 18 has a low height dimension such that the movable rail 18 can be disposed in a lower wall portion 1*a* below the heating chamber 3 of the cooking device body 1, and the structure simplicity can be thereby further improved. The rail body 20 penetrates the internal side wall 23 of the door 6 through a hole 28. Also, the front end portion 21 is formed of a triangle-shaped plate 21*a* continuing from the rail body 20, and a plate 21*b* bent from the triangle-shaped plate 21*a* and disposed along the internal face of the external side wall 24, and the attachment side of the bent plate 21*b* is the attachment end face 22. The attachment end face 22 is fixed to the internal side face of the external side wall 24 by screwing or welding.

Figure 4:
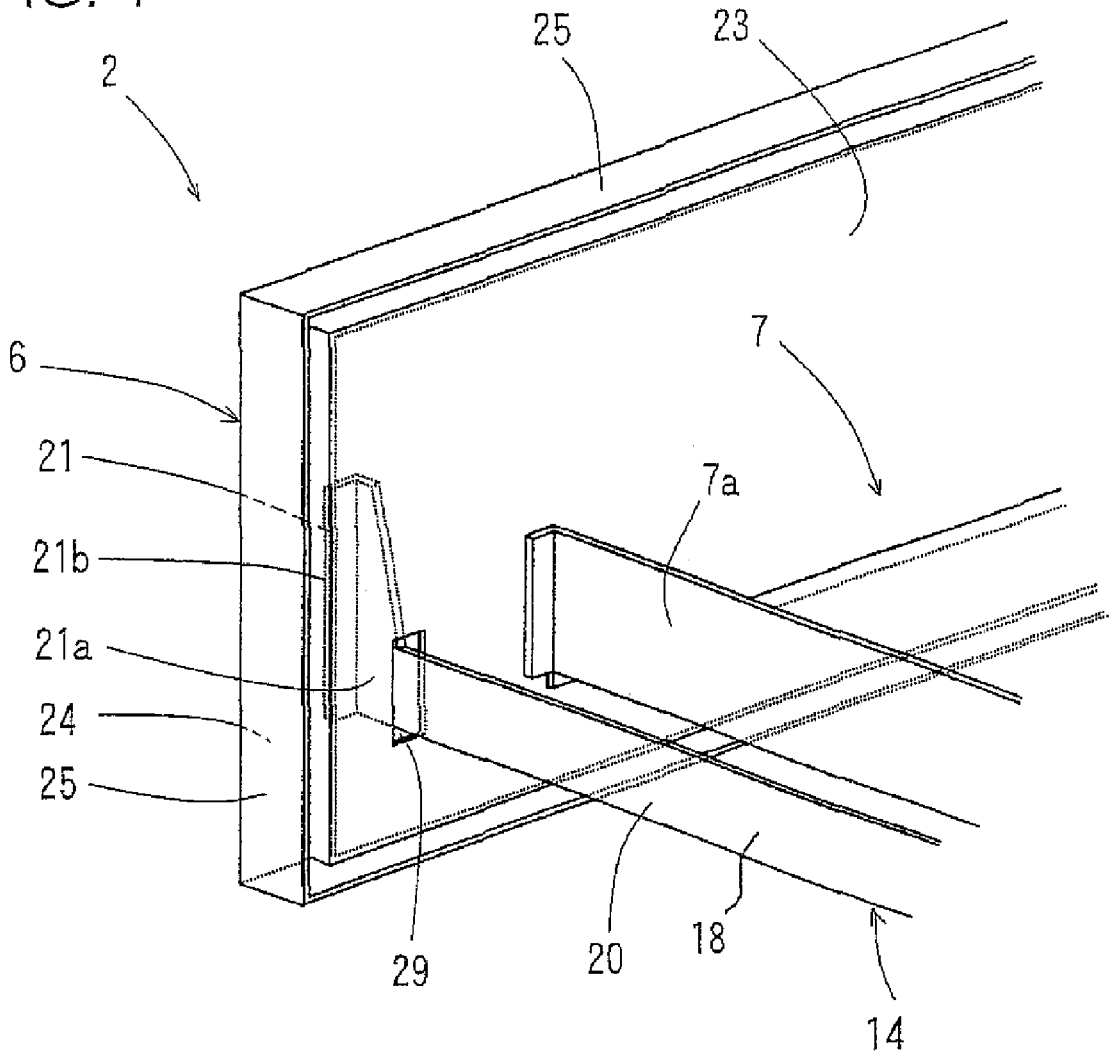
FIG. 4 is a perspective view illustrating a main portion of another embodiment of a drawer-type cooking device according to the present invention.

FIG. 4 is a perspective view illustrating a main portion of another embodiment of the drawer-type cooking device according to the present invention. A moving mechanism 24 is disposed in the sides of and in a height position lower than the side portion frame 7*a* of the heating container 7 although not in a direct lower position of the side portion frame 7*a*. The rail body 20 penetrates the internal side wall 23 of the door 6 through a hole 29. The rail body 20 has a larger height dimension than the one shown in FIG. 3. Since other structures are the same as those shown in FIG. 3, the same description is omitted.

What is claimed is:

1. A drawer-type microwave cooking device comprising:

a microwave cooking device body having a heating chamber formed therein;

a drawer including a drawer body having a heating container for carrying an object to be heated and a door operable to close the heating chamber when the heating container is positioned in the heating chamber; and a moving mechanism operable to engage the door in a manner to support the drawer while moving the drawer from a closed position in which the door closes the heating chamber with the heating container inserted into the heating chamber to an open position with the heating container outside of the open heating chamber to permit objects to be placed in and removed from the exposed heating container, wherein the moving mechanism is disposed in a lower position than the heating container to facilitate easy access to the heating container for placing objects on and removing objects from the heating container when the drawer is in the open position, and the moving mechanism includes a fixed rail attached to the cooking device body and a movable rail slidingly engaging with the fixed rail and operable to slide out from and into the cooking device body to move the drawer into the open position and the closed position, the movable rail having a front end portion that is bent to provide an upwardly extending plate portion that is further bent along a longest vertical edge of the plate portion to form an attachment end face that is fixedly attached to the door, wherein the movable rail comprises a rail body extending parallel to the fixed rail; wherein the door has a box structure which is surrounded by an internal side wall, an external side wall, and a circumference wall and has a space formed between the internal side wall and the external side wall, and the rail body of the movable rail penetrates the internal side wall of the door and extends to an inside of the space, and the front end portion of the moveable rail located inside the space is attached to an internal side surface of the external side wall of the door by the attachment end face.

2. The drawer-type cooking device according to claim 1, wherein the front end portion is formed in an L shape as a whole.

3. The drawer-type cooking device according to claim 1, wherein the moving mechanism is disposed below the heating chamber of the cooking device body.

* * * * *